US010122073B2

(12) United States Patent
Sano

(10) Patent No.: US 10,122,073 B2
(45) Date of Patent: Nov. 6, 2018

(54) ANTENNA AND TIMEPIECE

(71) Applicant: CASIO COMPUTER CO., LTD., Tokyo (JP)

(72) Inventor: Takashi Sano, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 174 days.

(21) Appl. No.: 15/189,204

(22) Filed: Jun. 22, 2016

(65) Prior Publication Data

US 2017/0018842 A1 Jan. 19, 2017

(30) Foreign Application Priority Data

Jul. 16, 2015 (JP) ..... 2015-142512

(51) Int. Cl.

| | |
|---|---|
| ***H01Q 1/12*** | (2006.01) |
| ***H01Q 1/27*** | (2006.01) |
| ***H01Q 1/38*** | (2006.01) |
| ***H01Q 9/04*** | (2006.01) |

(52) U.S. Cl.

CPC ..... *H01Q 1/273* (2013.01); *H01Q 1/38* (2013.01); *H01Q 9/0407* (2013.01)

(58) Field of Classification Search

None

See application file for complete search history.

(56) References Cited

U.S. PATENT DOCUMENTS

| | | | | |
|---|---|---|---|---|
| 4,884,252 | A * | 11/1989 | Teodoridis | H01Q 1/44 368/10 |
| 5,907,522 | A * | 5/1999 | Teodoridis | H01Q 1/273 343/718 |
| 8,867,320 | B2 * | 10/2014 | Suzuki | C03C 17/3435 368/205 |
| 8,995,236 | B2 * | 3/2015 | Fujisawa | G04R 60/12 343/718 |
| 2004/0183788 | A1 | 9/2004 | Kurashima et al. | |
| 2011/0176396 | A1 * | 7/2011 | Suzuki | C03C 17/3435 368/296 |
| 2011/0187609 | A1 * | 8/2011 | Abe | H01Q 1/00 343/702 |
| 2014/0086020 | A1 * | 3/2014 | Fujisawa | G04R 60/12 368/47 |

FOREIGN PATENT DOCUMENTS

JP 2004-234270 A 8/2004

* cited by examiner

*Primary Examiner* — Trinh Dinh

(74) *Attorney, Agent, or Firm* — Chen Yoshimura LLP

(57) ABSTRACT

An antenna-equipped cover glass for a wristwatch includes: a first insulating layer that includes a transparent insulator; a first electrode layer connected to a bottom surface of the first insulating layer, the first electrode layer having a first transparent electrode surrounded by an insulating pattern formed in a region therein; a second insulating layer connected to a bottom surface of the first electrode layer; and a second electrode layer connected to a bottom surface of the second insulating layer, the second electrode layer having a second transparent electrode surrounded by an insulating pattern formed in a region therein.

16 Claims, 11 Drawing Sheets

ANTENNA AND TIMEPIECE

BACKGROUND OF THE INVENTION

The present invention relates to an antenna and a timepiece.

Japanese Patent Application Laid-Open Publication No. 2004-234270 discloses a touch panel that includes an antenna.

The touch panel includes two films arranged facing each other with a prescribed gap therebetween and transparent electrodes respectively formed on the two films. The transparent electrodes detect differences in electric potential generated when the user touches the touch panel and also include a microstrip-shaped planar antenna.

Meanwhile, mobile devices such as wristwatches are sometimes equipped with an antenna for receiving Global Positioning System (GPS) signals, standard radio waves, or the like. However, arranging a large antenna in a prominent location on the mobile device impedes the original functionality and also negatively affects the design aesthetics of the device. Conversely, arranging a small antenna in a less prominent location on the device tends to result in poor reception sensitivity.

One solution to these problems is to form a transparent electrode on the cover glass of the mobile device in order to form an antenna for radio communications. However, in this case the shape of the transparent electrode formed on the cover glass tends to be easily visible, again negatively affecting the design aesthetics of the mobile device.

SUMMARY OF THE INVENTION

The present invention was made in light of the foregoing and aims to provide an antenna and a timepiece that maintain high communication sensitivity to radio waves without any negative effects on design aesthetics.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an antenna, including:

a first insulating layer that includes a transparent insulator;

a first electrode layer connected to a bottom surface of the first insulating layer, the first electrode layer having a first transparent electrode surrounded by an insulating pattern formed in a region therein;

a second insulating layer connected to a bottom surface of the first electrode layer; and a second electrode layer connected to a bottom surface of the second insulating layer, the second electrode layer having a second transparent electrode surrounded by an insulating pattern formed in a region therein.

It is to be understood that both the foregoing general description and the following detailed description are exemplary and explanatory, and are intended to provide further explanation of the invention as claimed.

DETAILED DESCRIPTION OF EMBODIMENTS

Embodiment 1

Figure 1:
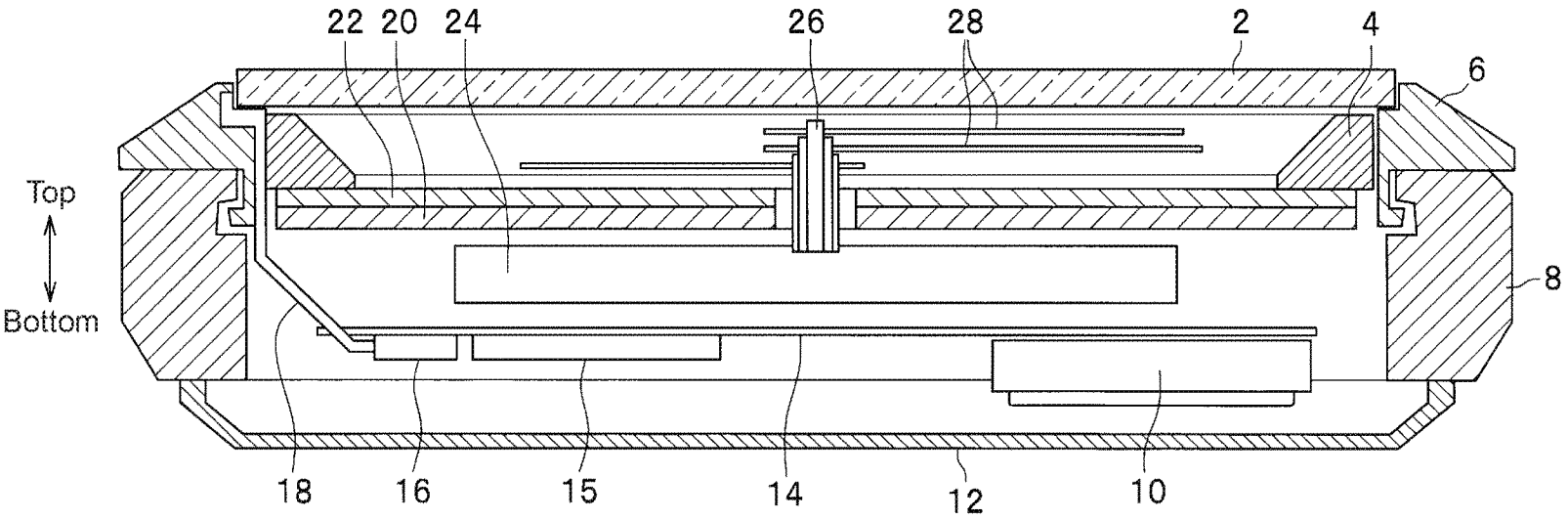
FIG. 1 is a cross-sectional view of a wristwatch according to Embodiment 1 of the present invention.

Next, a wristwatch according to Embodiment 1 of the present invention will be described in detail with reference to FIG. 1. FIG. 1 is a cross-sectional view of a substantially disk-shaped wristwatch cut in half.

As illustrated in FIG. 1, the wristwatch includes a substantially ring-shaped main case 8 and a substantially ring-shaped bezel 6 fitted onto the top surface of the main case 8. The top surface of an opening in the bezel is covered by a substantially disk-shaped antenna-equipped cover glass 2. The bottom surface of the main case 8 is covered by a back cover 12. Moreover, components such as a battery 10 and a circuit board 14 are housed within the main case 8. A communication module 15 is mounted on the circuit board 14. The communication module 15 is an integrated circuit that sends and receives radio waves via the antenna-equipped cover glass 2. A substantially ring-shaped dial cover plate 4 is arranged beneath the antenna-equipped cover glass 2, and the bottom surface of the dial cover plate 4 contacts a substantially disk-shaped dial plate 22.

A solar panel 20 with substantially the same diameter as the dial plate 22 is arranged on the bottom surface of the dial plate 22. An indicator hand shaft 26 goes through the solar panel 20 and the dial plate 22 and protrudes up therefrom, and a plurality of indicator hands 28 are attached to the indicator hand shaft 26. A wheel train mechanism 24 includes components such as a motor, a wheel train, and a housing and rotates the indicator hands 28 around the indicator hand shaft 26. The antenna-equipped cover glass 2 has a multilayer structure that includes transparent electrodes, and as will be described in more detail later, these transparent electrodes function as an antenna. Furthermore, the transparent electrodes are connected to the circuit board 14 via a flexible cable 18 and a connector 16. This allows the communication module 15 to send and receive radio signals via the antenna-equipped cover glass 2. Moreover, it is preferable that a microstrip line be used for the flexible cable 18 because the flexible cable 18 conveys high frequency signals.

Figure 2A:
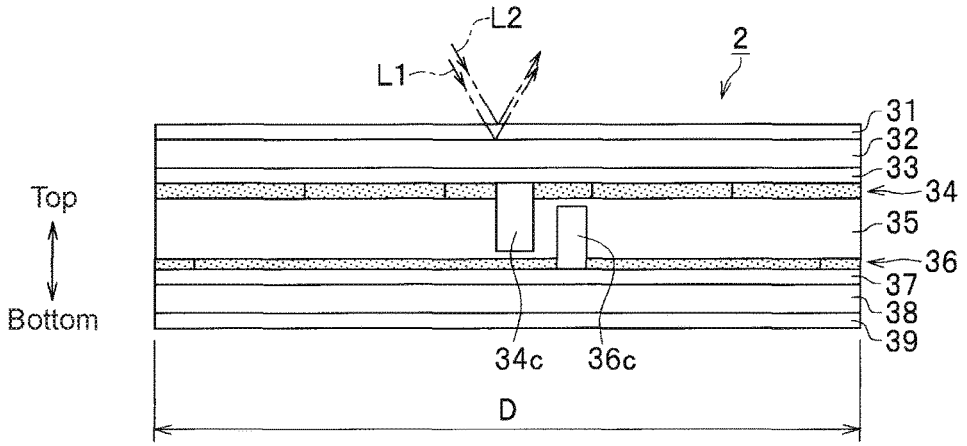
FIG. 2A is a side view of an antenna-equipped cover glass according to Embodiment 1.

Next, the configuration of the antenna-equipped cover glass 2 will be described in detail with reference to FIG. 2A. FIG. 2A is a side view of the antenna-equipped cover glass 2. Note that the dimensions in the vertical direction are exaggerated for clarity.

The antenna-equipped cover glass 2 includes an upper cover glass 32, a middle glass 35, and a lower cover glass 38, all of which are disk-shaped and of diameter D. It is preferable that a transparent material that has a relatively high relative permittivity in the frequency bands to be used for communication and a relatively low dissipation factor be selected for these components. Examples of suitable materials include sapphire glass, white glass, and fused quartz.

A top coating 31 is formed on the top surface of the upper cover glass 32. The top coating 31 is an antireflective film and utilizes optical interference to reduce the reflection of light off of the surface thereof. Next, the principle behind this effect will be described with reference to FIG. 2A. Assume that two light beams L1 and L2 are incident on the antenna-equipped cover glass 2. Also, assume that the light beam L1 reflects off of the top surface of the top coating 31, and the light beam L2 reflects off of the top surface of the upper cover glass 32, thereby causing the light beams L1 and L2 to overlap. In the overlapping portions of the light beams L1 and L2, if the phases of the reflected beams are shifted by 180° relative to one another, the reflected light beams cancel each other, making them difficult to perceive to the human eye. Although the principle behind the antireflection effect of the top coating 31 was described above, the same principle also applies to the other coatings that will be described below.

A middle upper coating 33 (which is also an antireflective film) is formed on the bottom surface of the upper cover glass 32. Furthermore, a radiating element layer 34 is arranged between the middle upper coating 33 and the middle glass 35, and a ground electrode layer 36 is formed on the bottom surface of the middle glass 35. The radiating element layer 34 and the ground electrode layer 36 will be described in more detail later. The lower cover glass 38 is arranged beneath the middle glass 35. Moreover, a middle lower coating 37 and a bottom coating 39 (which are both antireflective films) are formed on the top and bottom surfaces of the lower cover glass 38, respectively. The middle lower coating 37 contacts the bottom surface of the ground electrode layer 36. As a result, the overall appearance and shape of the antenna-equipped cover glass 2 is similar to a single-layer transparent plate.

Figure 2B:
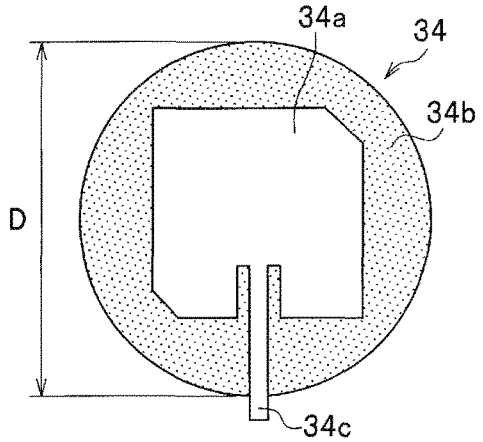
FIG. 2B is a plan view of a radiating element layer according to Embodiment 1.

Next, the configuration of the radiating element layer 34 will be described with reference to FIG. 2B, which is a plan view of the radiating element layer 34. As illustrated in FIG. 2B, the radiating element layer 34 includes a radiating element 34*a*, a filler 34*b*, and a lead wire 34*c*. The radiating element 34*a* is a substantially rectangular transparent electrode that is made from a material such as indium tin oxide (ITO) and is formed by making cutouts in the material as needed. The lead wire 34*c* is a long, rectangle-shaped portion of the same transparent electrode that forms the radiating element 34*a*. The lead wire 34*c* extends out from the radiating element 34*a* in the radial direction and protrudes out slightly in the radial direction from a circular region of diameter D. The filler 34*b* is an insulator having the same thickness as the transparent electrode that forms the radiating element 34*a*. The filler 34*b* is filled into all of the areas of the circular region of diameter D that are not occupied by the radiating element 34*a* or the lead wire 34*c*.

Here, the transmittance of the filler 34*b* may be set to a value approximately equal to the transmittance of the transparent electrode (for example, ±40% of the transmittance of the transparent electrode). It is preferable that the transmittance of the filler 34*b* be within ±20% of the transmittance of the transparent electrode and more preferable that the transmittance of the filler 34*b* be within ±10% of the transmittance of the transparent electrode. Moreover, the refractive index of the filler 34*b* may be set to a value approximately equal to the refractive index of the transparent electrode (for example, ±40% of the refractive index of the transparent electrode). It is preferable that the refractive index of the filler 34*b* be within ±20% of the refractive index of the transparent electrode and more preferable that the refractive index of the filler 34*b* be within ±10% of the refractive index of the transparent electrode.

Figure 2C:
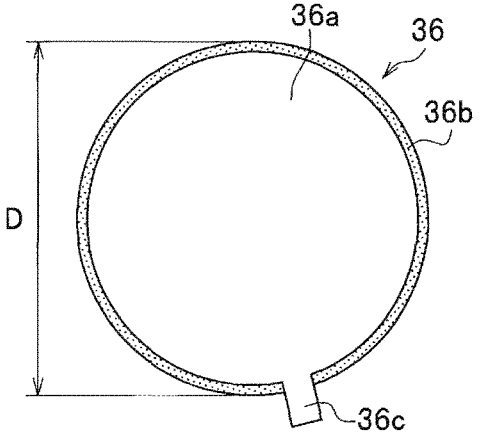
FIG. 2C is a plan view of a ground electrode layer according to Embodiment 1.

Next, the configuration of the ground electrode layer 36 will be described with reference to FIG. 2C, which is a plan view of the ground electrode layer 36. As illustrated in FIG. 2C, the ground electrode layer 36 includes a ground electrode 36*a*, a filler 36*b*, and a lead wire 36*c*. The ground electrode 36*a* is a disk-shaped transparent electrode that is made from the same material as the radiating element 34*a* and has a slightly smaller diameter than the diameter D. The lead wire 36*c* is a rectangle-shaped portion of the same transparent electrode that forms the ground electrode 36*a*. The lead wire 36*c* extends out from the ground electrode 36*a* in the radial direction and protrudes out slightly in the radial direction from a circular region of diameter D. The filler 36*b* is an insulator made from the same material as the filler 34*b* of the radiating element layer 34*a*. The filler 36*b* is filled into all of the areas of the circular region of diameter D that are not occupied by the ground electrode 36*a* or the lead wire 36*c*. In this way, the radiating element 34*a* of the radiating element layer 34 faces the ground electrode 36*a* of the ground electrode layer 36, thereby forming an antenna.

As illustrated in FIG. 2A, the lead wire 34*c* that protrudes out from the radiating element layer 34 is bent downwards. Moreover, the lead wire 36*c* that protrudes out from the ground electrode layer 36 is bent upwards. These lead wires 34*c* and 36*c* contact the flexible cable 18 (see FIG. 1), thereby connecting the antenna (the radiating element 34*a* and the ground electrode 36*a*) to the circuit board 14. Furthermore, a glassy resin may be injected at the connection between the flexible cable and the lead wires 34*c* and 36*c* to fix the components in place.

In the present embodiment, the top coating 31, the upper cover glass 32, and the middle upper coating 33 form a first insulating layer, and the middle glass 35 forms a second insulating layer. Moreover, the radiating element layer 34 forms a first electrode layer, and the radiating element 34*a* of the radiating element layer 34 forms a first transparent electrode. Similarly, the ground electrode layer 36 forms a second electrode layer, and the ground electrode 36*a* of the ground electrode layer 36 forms a second transparent electrode.

As described above, in the present embodiment the radiating element layer 34 is sandwiched between the middle upper coating 33 and the middle glass 35, and the filler 34*b* is filled into the areas that are not occupied by the radiating element 34*a* or the lead wire 34*c*, thereby making it possible to reduce the visibility of the radiating element 34*a* and the lead wire 34*c*. This makes it possible to use large-area electrodes for the radiating element 34*a* and the ground electrode 36*a* without negatively affecting the design aesthetics or functionality of the wristwatch, thereby making it possible for the wristwatch to perform radio communications with high sensitivity.

Moreover, in the present embodiment the antenna-equipped cover glass 2 is arranged as one of the outermost portions of the wristwatch housing, thereby making it possible to reduce the effects of any of the metal or magnetic components or the like of the wristwatch on radio communications and also making it possible to reduce the effects of noise generated by the circuit board 14. This reduces the need to adjust for these effects between different types of wristwatches, thereby making it easier to develop various types of wristwatches. Moreover, the antenna-equipped cover glass 2 of the present embodiment functions both as an antenna and as a cover glass, thereby allowing the antenna-equipped cover glass 2 to protect components such as the dial plate 22, the wheel train mechanism 24, and the indicator hands 28. Furthermore, this configuration removes the need to house a separate antenna within the wristwatch itself, thereby facilitating miniaturization of the wristwatch.

In the present embodiment, the antenna-equipped cover glass 2 is arranged above the solar panel 20 (in the direction from which radio waves enter the wristwatch), thereby making it possible to enhance the power generation efficiency of the solar panel 20. If, conversely, the solar panel 20 were arranged above the antenna, the shape of the solar panel 20 would need to be adjusted to avoid blocking the antenna, thereby decreasing the power generation efficiency and also creating various other design constraints on the solar panel 20. In the present embodiment, the solar panel 20 can be arranged beneath the antenna-equipped cover glass 2, thereby reducing design constraints on the solar panel 20 and making it possible to use an efficient solar panel 20.

Furthermore, in the present embodiment the antenna-equipped cover glass 2 is arranged above the dial plate 22. This makes it possible to limit deterioration in communication sensitivity even if metal components are used for the dial plate 22, thereby facilitating use of metal components for the dial plate 22.

Moreover, in the present embodiment the transparent electrodes such as the radiating element 34*a* and the ground electrode 36*a* are arranged beneath the upper cover glass 32. This allows the upper cover glass 32 to protect the radiating element 34*a* and the ground electrode 36*a*. Furthermore, the upper cover glass 32 can also function as a dielectric glass that focuses the received radio waves, thereby making it possible to make the antenna-equipped cover glass 2 smaller. In addition, the performance of the antenna can be easily adjusted by making cutouts in the ground electrode 36*a* as appropriate.

In the present embodiment, the coatings 31, 33, 37, and 39 are antireflective films, thereby making it possible to reduce the reflectance of the antenna-equipped cover glass 2. This makes it possible to improve the display quality of the wristwatch as well as enhance the power generation efficiency of the solar panel 20.

The overall appearance and shape of the antenna-equipped cover glass 2 according to the present embodiment is similar to those of cover glasses used in conventional wristwatches, thereby making it possible to fix the antenna-equipped cover glass 2 to the wristwatch using the same methods that are used with conventional cover glasses (such as using a resin ring to form a waterproof seal, for example). Moreover, the antenna is integrated into the cover glass itself, thereby making it possible to reduce the potential for deterioration in antenna performance due to impacts caused by dropping the wristwatch or the like.

Furthermore, in the antenna-equipped cover glass 2 of the present embodiment, the lead wires 34*c* and 36*c* protrude out from the radiating element 34*a* and the ground electrode 36*a* in the horizontal direction, thereby making it possible to attach other wires thereto without forming holes or cutouts in the antenna-equipped cover glass 2.

Embodiment 2

Next, a wristwatch according to Embodiment 2 of the present invention will be described. The same reference characters will be used for components that are the same as in Embodiment 1, and descriptions of these components will be omitted here.

Figure 3A:
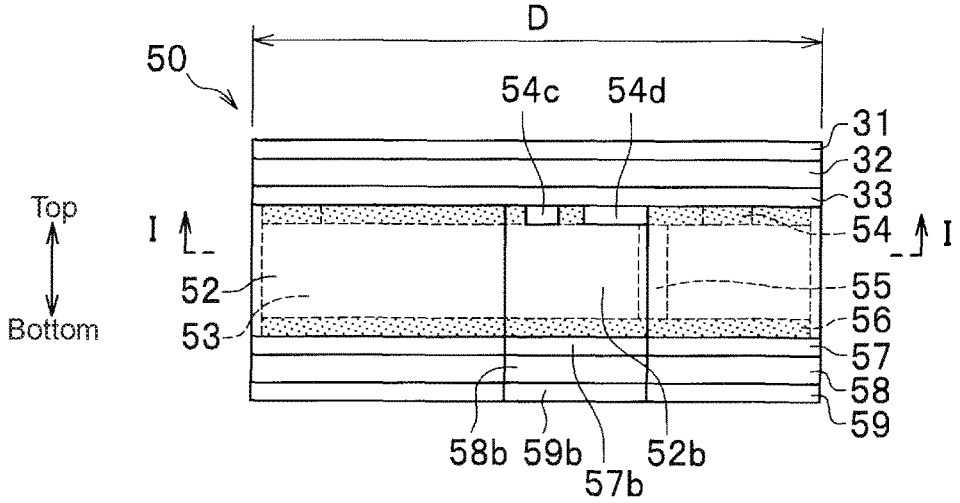
FIG. 3A is a side view of an antenna-equipped cover glass according to Embodiment 2.
Figure 3B:
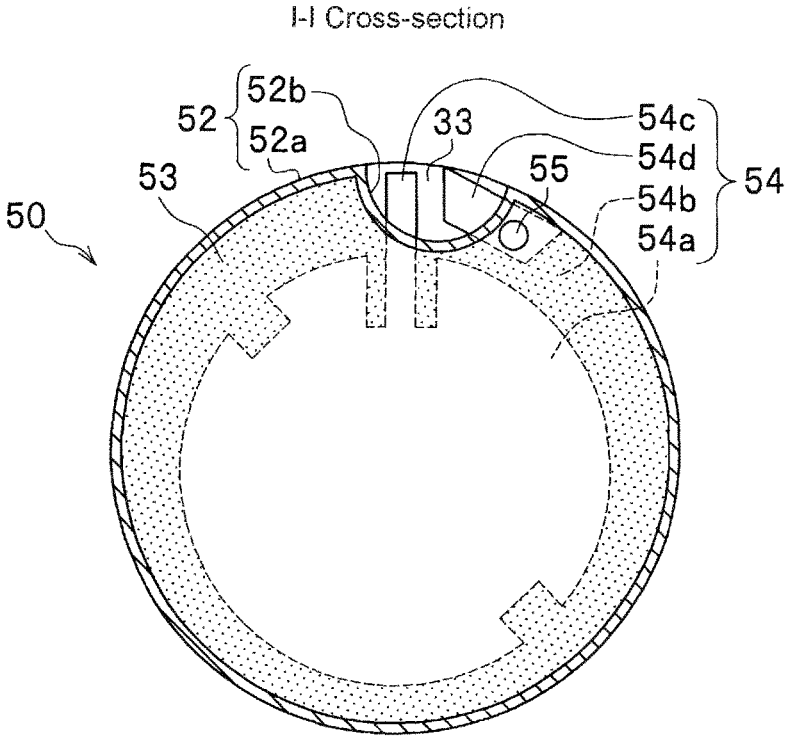
FIG. 3B is a cross-sectional view of the antenna-equipped cover glass according to Embodiment 2.

The overall configuration of the wristwatch according to Embodiment 2 is similar to Embodiment 1 (see FIG. 1) except in that the antenna-equipped cover glass 2 is replaced with an antenna-equipped cover glass 50, which is illustrated in FIGS. 3A and 3B. FIG. 3A is a side view of the antenna-equipped cover glass 50. Note that the dimensions in the vertical direction are exaggerated for clarity. Moreover, FIG. 3B is a cross-sectional view taken along line I-I in FIG. 3A.

As illustrated in FIG. 3A and like in Embodiment 1 (see FIG. 2A), a top coating 31, an upper cover glass 32, and a middle upper coating 33 are formed in disk shapes of diameter D. A substantially cylinder-shaped sealing material 52 is fixed beneath the middle upper coating 33. As illustrated in FIG. 3B, the sealing material 52 includes a cylinder portion 52*a* and a recess 52*b*. The cylinder portion 52*a* extends around substantially the entire periphery of the middle upper coating 33, except for the portion in which the recess 52*b* is formed. The recess 52*b* has a circular cross section and recedes inwards.

Moreover, as illustrated in FIG. 3A, a radiating element layer 54 is arranged on the inner side of the sealing material 52 on the bottom surface of the middle upper coating 33. Next, the configuration of the radiating element layer 54 will be described in detail with reference to FIG. 3B. The radiating element layer 54 includes a radiating element 54*a*, a filler 54*b*, a lead wire 54*c*, and a ground terminal 54*d*. The radiating element 54*a* is a substantially circular transparent electrode that is made from a material such as ITO and is formed by making cutouts in the material as needed. The lead wire 54*c* is a long, rectangle-shaped portion of the same transparent electrode that forms the radiating element 54*a*. The lead wire 54*c* extends out from the radiating element 54*a* in the radial direction, and the end of the lead wire 54*c* is exposed in the recess 52*b* of the sealing material 52.

Furthermore, the ground terminal 54*d* is a substantially trapezoid-shaped portion of the same transparent electrode that forms the radiating element 54*a*, and the ground terminal 54*d* is arranged near the lead wire 54*c*. Approximately half of the ground terminal 54*d* is exposed in the recess 52*b* of the sealing material 52. The filler 54*b* has the same thickness as the transparent electrode that forms the radiating element 54*a* and is made from an insulator that has approximately the same transmittance and refractive index as the transparent electrode (for example, within ±40% of the transmittance and refractive index of the transparent electrode). The filler 54*b* is filled into all of the areas on the inner side of the sealing material 52 that are not occupied by the radiating element 54*a*, the lead wire 54*c*, or the ground terminal 54*d*.

As illustrated in FIG. 3A, a middle lower coating 57, a lower cover glass 58, and a bottom coating 59 are arranged beneath the sealing material 52. These components 57 to 59 have the same functions as the components 37 to 39 of the same names in Embodiment 1 (see FIG. 2). However, in the present embodiment the components 57 to 59 are formed according to the shape of the sealing material 52. In other words, recesses 57*b*, 58*b*, and 59*b* are respectively formed in the components 57, 58, and 59 in the locations thereof facing the recess 52*b* of the sealing material 52.

Moreover, as illustrated in FIG. 3A, a ground electrode 56 is arranged on the inner side of the sealing material 52 on the top surface of the middle lower coating 57. The ground electrode 56 is a transparent electrode made from the same material as the radiating element 54*a* and is formed in a shape that follows the inner walls of the sealing material 52. A rod-shaped conductor pin 55 is inserted between the ground electrode 56 and the ground terminal 54*d* of the radiating element layer 54, thereby electrically connecting the ground electrode 56 to the ground terminal 54*d*. Moreover, as illustrated in FIG. 3B, a dielectric 53 (an insulator) is formed in the space on the inner side of the sealing material 52. A solid, liquid, or gel material may be used for the dielectric 53. Moreover, it is preferable that a material in which the permittivity changes when a DC voltage is applied thereto be used for the dielectric 53.

Figure 4A:
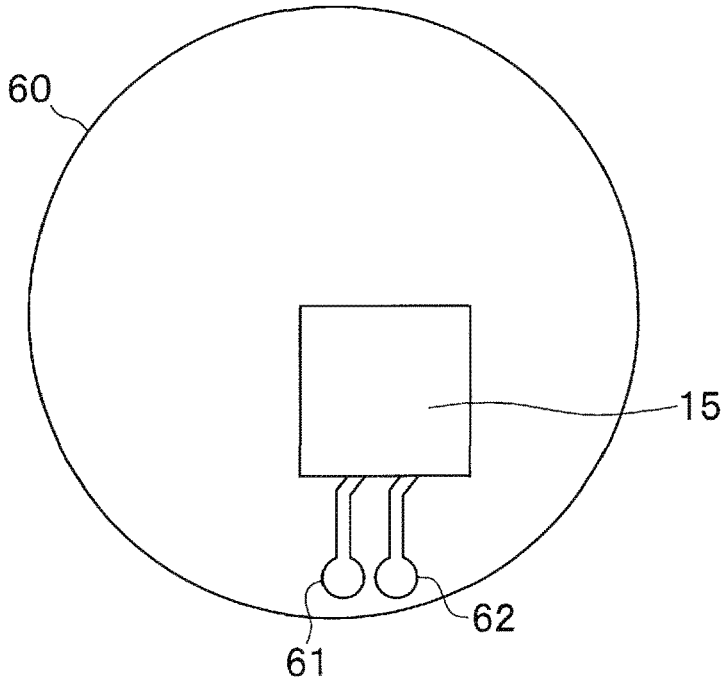
FIG. 4A is a plan view of the main components of a circuit board according to Embodiment 2.
Figure 4B:
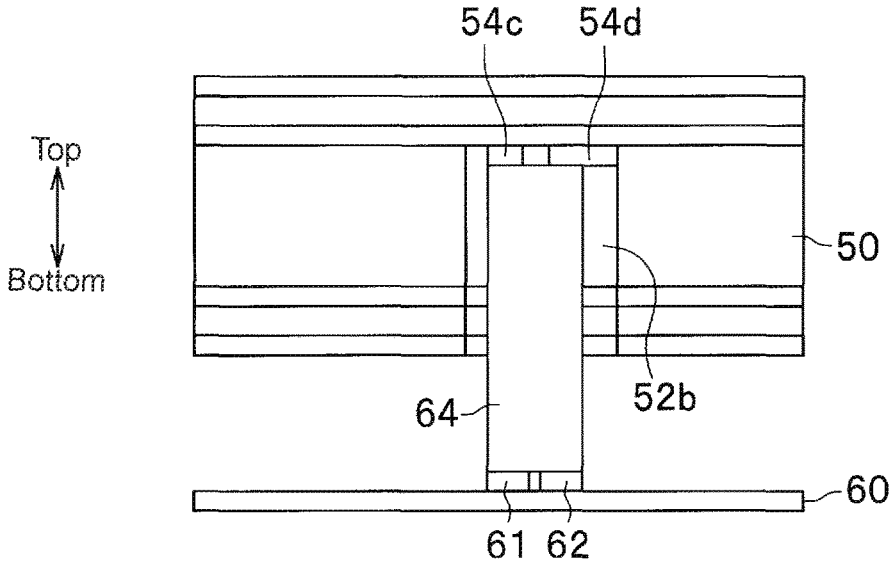
FIG. 4B is a side view of the main components of a wristwatch according to Embodiment 2.

In the present embodiment, the circuit board 14 of Embodiment 1 is replaced with a circuit board 60, which is illustrated in FIG. 4A. FIG. 4A is a plan view of the main components of the circuit board 60. The circuit board 60 includes a signal terminal 61 and a ground terminal 62 made from copper foil or the like, and these terminals are connected to a communication module 15. Next, the connections between the antenna-equipped cover glass 50 and the circuit board 60 will be described with reference to FIG. 4B, which is a side view of the main components of the wristwatch. As illustrated in FIG. 4B, the antenna-equipped cover glass 50 and the circuit board 60 are arranged parallel to one another, with the lead wire 54*c* facing the signal terminal 61 and the ground terminal 54*d* facing the ground terminal 62.

A connector 64 is formed by shaping a compressible resin into a substantially rectangular prism shape. More specifically, the connector 64 is formed by arranging a plurality of fine wires that are made from a conductive material (such as conductive rubber or a metal) and conduct electricity in the vertical direction into a comb-shaped pattern and then surrounding the conductive material with an insulating resin (such as silicone sponge rubber) to form a single integrated component. As illustrated in FIG. 4B, the connector 64 is arranged between the antenna-equipped cover glass 50 and the circuit board 60, thereby connecting the lead wire 54*c* to the signal terminal 61 and connecting the ground terminal 54*d* to the ground terminal 62 via the plurality of fine wires made from the conductive material. This allows the communication module 15 to send and receive radio signals via the antenna-equipped cover glass 50.

In the present embodiment, the top coating 31, the upper cover glass 32, and the middle upper coating 33 form a first insulating layer, and the dielectric 53 forms a second insulating layer. Moreover, the radiating element layer 54 forms a first electrode layer, and the radiating element 54*a* of the radiating element layer 54 forms a first transparent electrode. Similarly, the ground electrode 56 forms a second electrode layer or a second transparent electrode. The signal terminal 61 of the circuit board 60 forms a first terminal, and the ground terminal 62 forms a second terminal.

Therefore, the present embodiment as described above achieves the same effects as Embodiment 1. Furthermore, in the present embodiment the recesses 52*b*, 57*b*, 58*b*, and 59*b* are respectively formed in the sealing material 52, the middle lower coating 57, the lower cover glass 58, and the bottom coating 59, thereby exposing the lead wire 54*c* and the ground terminal 54*d* when viewing the antenna-equipped cover glass 50 from the bottom side thereof (see FIG. 3B). Furthermore, as illustrated in FIG. 4B, the lead wire 54*c* and the ground terminal 54*d* are respectively connected to the terminals 61 and 62 via the connector 64 or the like. This removes the need to bend the transparent electrodes (the lead wire 54*c* and the ground terminal 54*d*) in the present embodiment, thereby making it possible to use materials that are difficult to bend for the transparent electrodes if necessary.

The connector 64 may be sandwiched between metal plates to achieve a prescribed characteristic impedance. This type of configuration makes it possible to match the impedances of the other components, thereby making it possible to reduce signal loss.

Furthermore, using a material in which the permittivity changes when a DC voltage is applied thereto for the dielectric 53 makes it possible to select one of a plurality of communication frequencies by changing the DC voltage applied to the lead wire 54*c* and the ground terminal 54*d*. The radio signals sent and received by the wristwatch of the present embodiment may include several types of signals (such as standard radio waves, GPS signals, and communication signals exchanged between devices), and different communication frequencies are used for each type of signal. Therefore, changing the permittivity of the dielectric 53 to switch between communication frequencies makes it possible for the antenna-equipped cover glass 50 to send and receive signals on a plurality of different communication frequencies.

Embodiment 3

Next, a wristwatch according to Embodiment 3 of the present invention will be described. The same reference characters will be used for components that are the same as in Embodiments 1 and 2, and descriptions of these components will be omitted here.

Figure 5A:
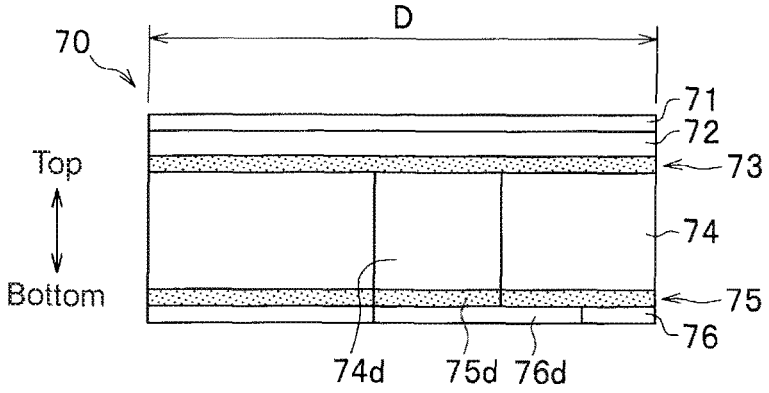
FIG. 5A is a side view of an antenna-equipped cover glass according to Embodiment 3.

The overall configuration of the wristwatch according to Embodiment 3 is similar to Embodiment 1 (see FIG. 1) except in that the antenna-equipped cover glass 2 is replaced with an antenna-equipped cover glass 70, which is illustrated in FIG. 5A. FIG. 5A is a side view of the antenna-equipped cover glass 70. Note that the dimensions in the vertical direction are exaggerated for clarity.

As illustrated in FIG. 5A, the antenna-equipped cover glass 70 includes a disk-shaped upper cover glass 72 and a substantially disk-shaped lower cover glass 74. A top coating 71 (an antireflective film) is formed on the top surface of the upper cover glass 72, and a radiating element layer 73 is arranged between the upper cover glass 72 and the lower cover glass 74. Moreover, a ground electrode layer 75 is formed on the bottom surface of the lower cover glass 74, and a bottom coating 76 (an antireflective film) is formed on the bottom surface of the ground electrode layer 75. Furthermore, recesses 74*d* and 75*d* that have the same shape and recede inwards are respectively formed in the lower cover glass 74 and the ground electrode layer 75. In addition, a wider recess 76*d* is formed in the bottom coating 76.

Figure 5B:
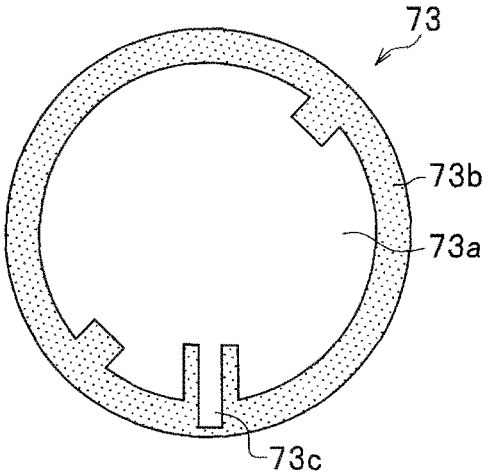
FIG. 5B is a plan view of a radiating element layer according to Embodiment 3.
Figure 5C:
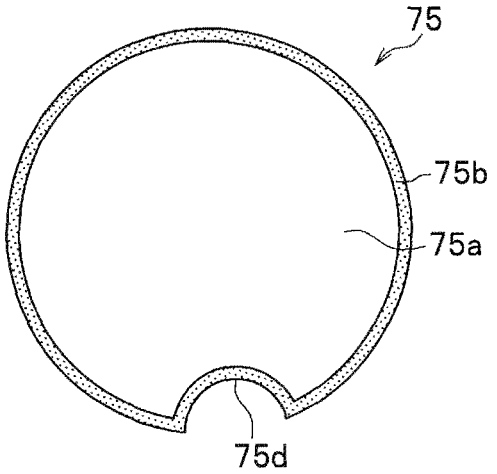
FIG. 5C is a plan view of a ground electrode layer according to Embodiment 3.

FIG. 5B is a plan view of the radiating element layer 73. Like the radiating element layer 54 in Embodiment 2 (see FIG. 3B), the radiating element layer 73 includes a radiating element 73*a* and a lead wire 73*c* that are made from a transparent electrode. Moreover, a filler 73*b* is filled into the areas that are not occupied by the radiating element 73*a* or the lead wire 73*c*. FIG. 5C is a plan view of the ground electrode layer 75. The ground electrode layer 75 includes a ground electrode 75*a* made from a transparent electrode that is formed on an area of the bottom surface of the lower cover glass 74 (see FIG. 5A) that does not include the periphery thereof. Moreover, a filler 75*b* (an insulator) is filled into the periphery of the bottom surface of the lower cover glass 74 (that is, the area not occupied by the ground electrode 75*a*).

Figure 5D:
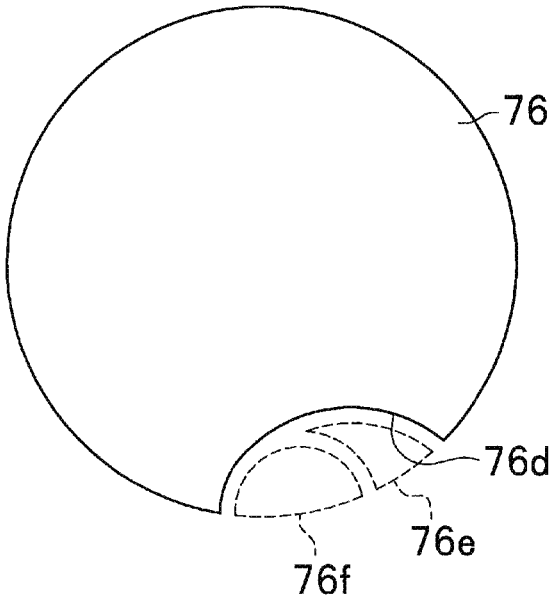
FIG. 5D is a plan view of a bottom coating according to Embodiment 3.

FIG. 5D is a plan view of the bottom coating 76. The recess 76*d* formed in the bottom coating 76 is wider than the recesses 74*d* and 75*d* by the region 76*e* that is indicated by the dashed line. Therefore, when viewing the antenna-equipped cover glass 70 from the bottom side thereof, a portion of the ground electrode 75*a* is exposed in the region 76*e*, and a portion of the lead wire 73*c* of the radiating element 73*a* is exposed in the region 76*f*. Furthermore, the materials used for the upper cover glass 72, the lower cover glass 74, the transparent electrodes, and the fillers may be the same materials used for the corresponding components in Embodiment 1.

Figure 6:
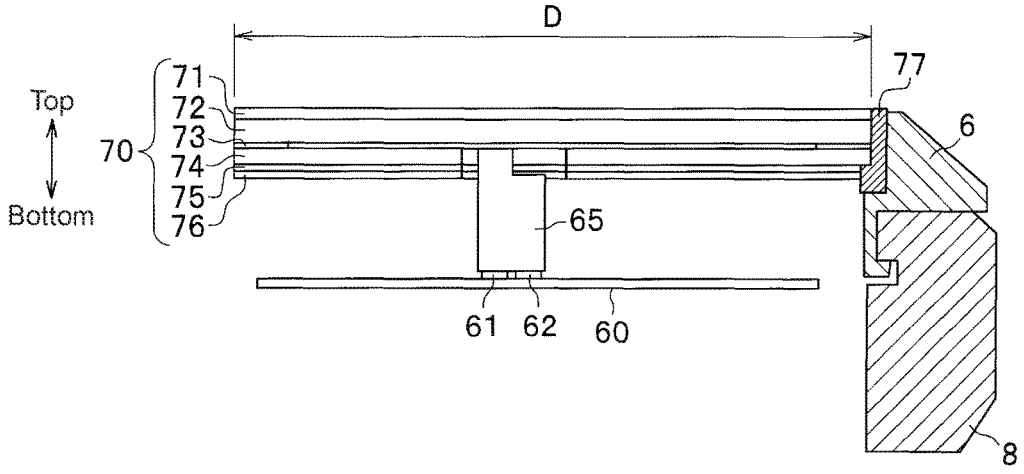
FIG. 6 is a cross-sectional view of the main components of a wristwatch according to Embodiment 3.

FIG. 6 is a cross-sectional view of the main components of the wristwatch according to the present embodiment. A circuit board 60 is the same as the circuit board used in Embodiment 2 (see FIG. 4A) and includes a signal terminal 61 and a ground terminal 62. In the present embodiment, the height of the exposed portions of the radiating element layer 73 and the ground electrode layer 75 are slightly different, and therefore a step shape is cut into the top end of a connector 65. In this way, the lead wire 73*c* (see FIG. 5B) is connected to the signal terminal 61, and the ground electrode 75*a* (see FIG. 5C) is connected to the ground terminal 62.

A resin is filled into the area between the sidewall of the antenna-equipped cover glass 70 and a bezel 6 to form a peripheral resin member 77. In the antenna-equipped cover glass 70 of the present embodiment, the radiating element 73*a* and the lead wire 73*c* are not exposed on the outer side of the sidewall of the antenna-equipped cover glass 70, and therefore the peripheral resin member 77 may be made from a conductive material. However, if the radiating element 73*a* and the lead wire 73*c* are exposed on the outer side of the sidewall of the antenna-equipped cover glass 70, an insulating material may be used for the peripheral resin member 77.

As described above, in the present embodiment portions of the radiating element 73*a* and the lead wire 73*c* are exposed when the antenna-equipped cover glass 70 is viewed from the bottom side thereof, thereby making it possible to use the connector 65 to connect the radiating element 73*a* to the signal terminal 61 and connect the ground electrode 75*a* to the ground terminal 62. Like in Embodiment 2, this removes the need to bend the transparent electrodes, thereby making it possible to use materials that are difficult to bend for the transparent electrodes if necessary.

In the present embodiment, the top coating 71 and the upper cover glass 72 form a first insulating layer, and the lower cover glass 74 forms a second insulating layer. Moreover, the radiating element layer 73 forms a first electrode layer, and the radiating element 73*a* of the radiating element layer 73 forms a first transparent electrode. Similarly, the ground electrode layer 75 forms a second electrode layer, and the ground electrode 75*a* of the ground electrode layer 75 forms a second transparent electrode.

Embodiment 4

Next, a wristwatch according to Embodiment 4 of the present invention will be described. The same reference characters will be used for components that are the same as in Embodiments 1 to 3, and descriptions of these components will be omitted here.

Figure 7:
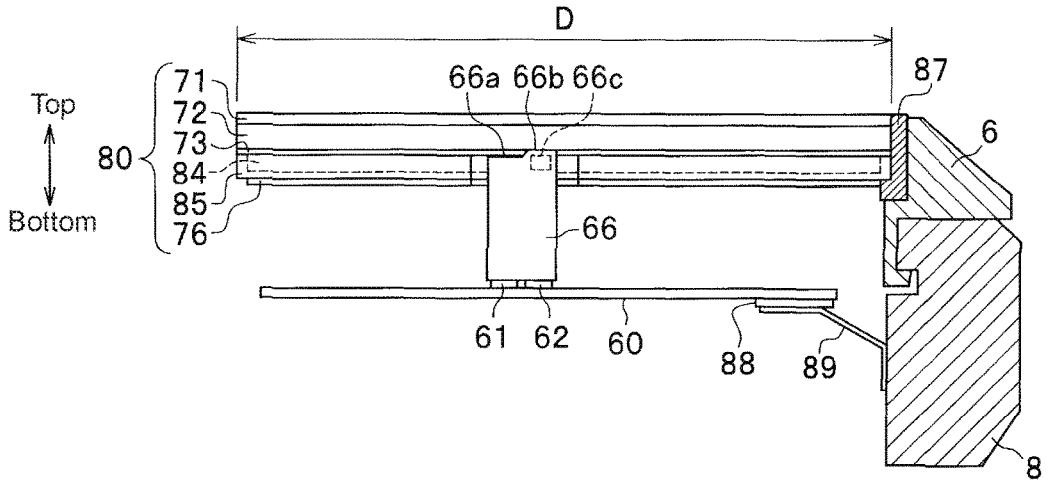
FIG. 7 is a cross-sectional view of the main components of a wristwatch according to Embodiment 4.

The overall configuration of the wristwatch according to Embodiment 4 is similar to Embodiment 3 (see FIG. 6) except in that in the present embodiment, the antenna-equipped cover glass 70 of Embodiment 3 is replaced with an antenna-equipped cover glass 80, which is illustrated in FIG. 7. FIG. 7 is a cross-sectional view of the main components of the wristwatch according to the present embodiment.

Like the antenna-equipped cover glass 70 of Embodiment 3, the antenna-equipped cover glass 80 of the present embodiment includes a top coating 71, an upper cover glass 72, a radiating element layer 73, and a bottom coating 76. However, as illustrated in FIG. 7, the present embodiment is different than Embodiment 3 in that the lower cover glass 74 and the ground electrode layer 75 of Embodiment 3 are replaced by a lower cover glass 84 and a ground electrode layer 85.

Figure 8A:
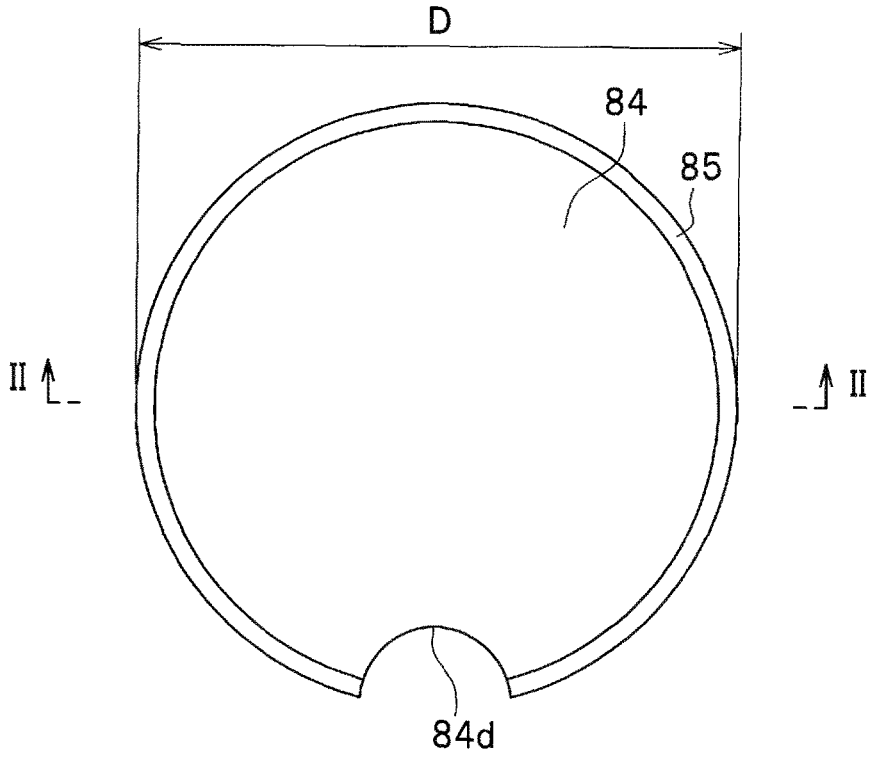
FIG. 8A is a plan view of a lower cover glass and a ground electrode layer according to Embodiment 4.
Figure 8B:
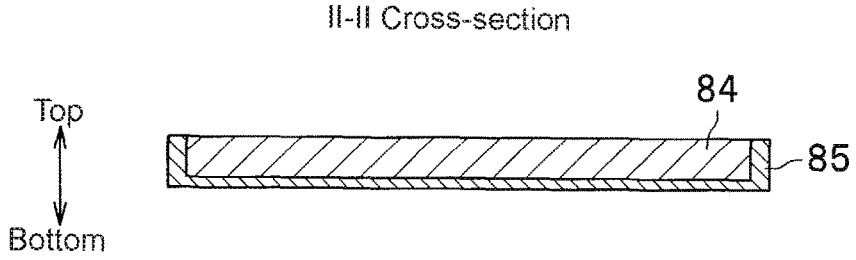
FIG. 8B is a cross-sectional view of the lower cover glass and the ground electrode layer according to Embodiment 4.

Next, the lower cover glass 84 and the ground electrode layer 85 will be described in detail with reference to FIGS. 8A and 8B. FIG. 8A is a plan view of the lower cover glass 84 and the ground electrode layer 85, and FIG. 8B is a cross-sectional view taken along line II-II in FIG. 8A. The lower cover glass 84 has a slightly smaller diameter than the diameter D of the antenna-equipped cover glass 80, and a recess 84*d* is formed in the lower cover glass 84. Moreover, the diameter of the lower cover glass 84 is slightly larger than the diameter of a radiating element 73*a* (see FIG. 5B). The ground electrode layer 85 is formed on the bottom surface and side face of the lower cover glass 84 in the areas not occupied by the recess 84*d*.

As illustrated in FIG. 7, a connector 66 is inserted between the antenna-equipped cover glass 80 and a circuit board 60. The left side 66*a* of the top surface of the connector 66 contacts a lead wire 73*c* (see FIG. 5B), thereby connecting the radiating element 73*a* to a signal terminal 61. Moreover, the right side 66*b* of the top surface of the connector 66 is left open. As described above, the connector 66 is formed by sealing a plurality of fine wires made from a conductive material inside an insulating resin. However, in the present embodiment the insulating resin is stripped off in a region 66*c* that is arranged beneath the right side 66*b* of the top surface of the connector 66 and contacts the ground electrode layer 85, and therefore the conductive material inside the connector 66 contacts the ground electrode layer 85. In this way, the ground electrode layer 85 is connected to a ground terminal 62 of the circuit board 60 via the connector 66.

Furthermore, in the present embodiment a bezel 6 and a main case 8 of the wristwatch are made from a conductive material (that is composed primarily of a metal). In addition, a conductive resin is filled into the area between the peripheral face of the antenna-equipped cover glass 80 and the bezel 6 to form a conductive peripheral resin member 87. Moreover, in the present embodiment a ground electrode 88 is also formed on the bottom surface of the circuit board 60, and the ground electrode 88 and the main case 8 are electrically connected via a contact member 89.

As described above and like in Embodiment 3, in the present embodiment a portion of the lead wire 73*c* is exposed when the antenna-equipped cover glass 80 is viewed from the bottom side thereof, thereby making it possible to use the connector 66 to connect the lead wire 73*c* to the signal terminal 61. Furthermore, in the present embodiment, substantially the entire peripheral face of the ground electrode layer 85 is connected via the conductive peripheral resin member 87 to the bezel 6, the main case 8, the contact member 89, and the ground electrode 88, thereby making it possible to reduce resistance between the ground electrode layer 85 and the ground electrode 88.

In the present embodiment, the top coating 71 and the upper cover glass 72 form a first insulating layer, and the lower cover glass 84 forms a second insulating layer. Moreover, the radiating element layer 73 forms a first electrode layer, and the radiating element 73*a* of the radiating element layer 73 forms a first transparent electrode. Similarly, the ground electrode layer 85 forms a second electrode layer or a second transparent electrode.

Modification Examples

The present invention is not limited to the embodiments described above, and various modifications may be made. The embodiments described above are nothing more than examples intended to facilitate understanding of the present invention, and the present invention is not necessarily limited to configurations that include all of the components described above. Furthermore, components of the configurations of the embodiments may be replaced using a component from another embodiment, or components from one embodiment may be added to the configuration of another embodiment. Moreover, components may be removed from the configurations of the embodiments, and other components may be added or substituted into the configurations of the embodiments. Possible modifications to the embodiments described above include the following, for example.

Figure 9:
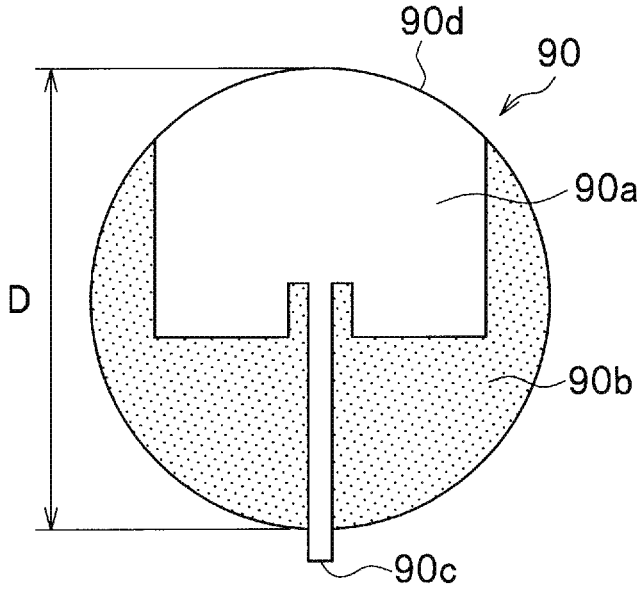
FIG. 9 is a plan view of a modification example of the radiating element layer of the embodiments.

(1) In the embodiments described above, the radiating elements 34*a*, 54*a*, and 73*a* were shaped by making cutouts in a rectangular or circular transparent electrode. However, these radiating elements may be replaced with radiating elements of a variety of other shapes. For example, as illustrated in FIG. 9, the radiating element layers 34, 54, and 73 may be replaced with a radiating element layer 90 that functions as a quarter-wavelength antenna. As illustrated in FIG. 9, a radiating element 90*a* is formed covering approximately half of the radiating element layer 90 of diameter D, and a peripheral portion 90*d* of the radiating element layer 90 is connected to a ground electrode (not illustrated in the figure). A lead wire 90*c* extends out from the radiating element 90*a* in the radial direction. Moreover, a filler 90*b* is filled into the areas of a circular region of diameter D that are not occupied by the radiating element 90*a* or the lead wire 90*c*. Furthermore, a type of antenna other than that illustrated in FIG. 9 may also be used, such as an inverted-F antenna or a slit antenna.

Figure 10:
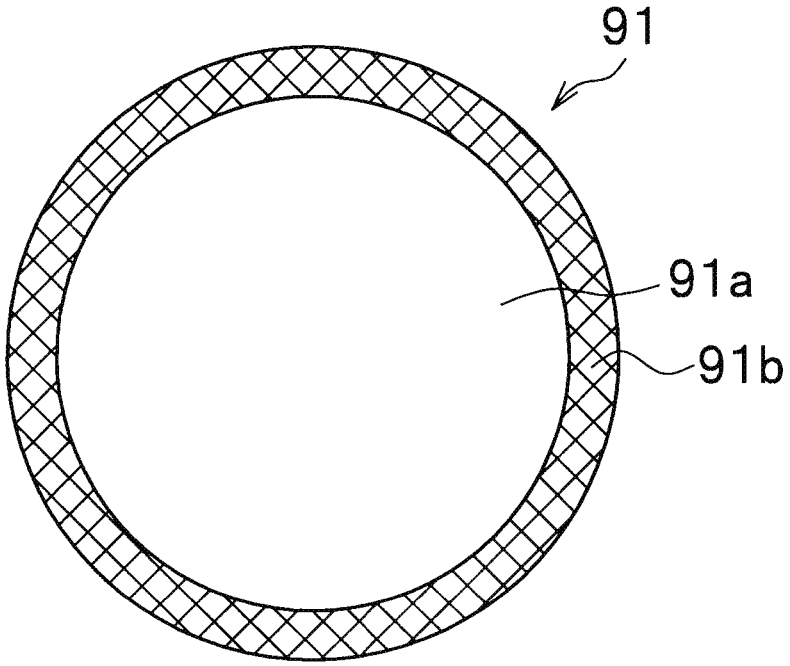
FIG. 10 is a plan view of a modification example of a top coating of the embodiments.

(2) In the embodiments described above, the top coatings 31 and 71 were entirely transparent. However, the peripheral portion of the top coating may be colored. FIG. 10 illustrates an example. As illustrated in FIG. 10, a peripheral ring-shaped portion 91*b* of a top coating 91 is colored black, and the remaining portion 91*a* is transparent. This makes it possible to hide from sight components such as the flexible cable 18 and the connectors 64, 65, and 66 which are arranged beneath the periphery of the antenna-equipped cover glasses 2, 50, 70, and 80. Moreover, forming a colored portion is not limited to the top coating 91, and the other layers beneath the top coating 91 may also include ring-shaped colored portions.

(3) In the embodiments described above, the capacitance between the radiating elements 34*a*, 54*a*, and 73*a* and the ground electrodes 36*a*, 56, 75*a*, and 85 changes if the user touches the top coatings 31 and 71 of the antenna-equipped cover glasses 2, 50, 70, and 80. These changes in capacitance may be detected and in order to make the antenna-equipped cover glasses 2, 50, 70, and 80 function as touch panels.

(4) In the embodiments described above, the flexible cable 18 and the connectors 64, 65, and 66 may be replaced with connection pins. Here, "connection pin" refers to a component that includes a cylinder-shaped outer casing made from metal, a rod-shaped metal pin that is inserted into the outer casing, and a coil spring that is housed inside the outer casing and applies an outward force to the pin. The coil spring creates parasitic inductance and may therefore negatively affect the transmission properties of the connection pin. However, the connection pin can still be used if such negative effects are relatively minor. Unlike the flexible cable 18, connection pins do not need to be fixed to the connector 16, thereby simplifying assembly and disassembly of the wristwatch.

It will be apparent to those skilled in the art that various modification and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A timepiece, comprising:

an antenna that comprises:

a first insulating layer that includes a transparent insulator;

a first electrode layer connected to a bottom surface of the first insulating layer, the first electrode layer having a first transparent electrode at least partially surrounded by an insulating pattern formed in a region of the first electrode layer;

a second insulating layer connected to a bottom surface of the first electrode layer; and a second electrode layer connected to a bottom surface of the second insulating layer, the second electrode layer having a second transparent electrode at least partially surrounded by an insulating pattern formed in a region of the second electrode layer;

a circuit board on which a communication circuit that performs communication via the antenna is mounted;

a dial plate arranged between the antenna and the circuit board; and a connector, wherein the connector is arranged between the antenna and the circuit board, and wherein the connector includes a first terminal that connects to the first transparent electrode and a second terminal that connects to the second transparent electrode.

2. The timepiece according to claim 1, wherein the second insulating layer includes a dielectric having a permittivity that changes in accordance with a DC voltage applied to the first electrode layer and the second electrode layer.

3. The timepiece according to claim 1, wherein the insulating pattern in the first electrode layer is a filler formed in a region of the first electrode layer in which the first transparent electrode is not formed.

4. The timepiece according to claim 3, wherein a transmittance of the filler in the first electrode layer is within ±40% of a transmittance of the first transparent electrode, and wherein a refractive index of the filler in the first electrode layer is within ±40% of a refractive index of the first transparent electrode.

5. The timepiece according to claim 1, wherein the first insulating layer includes:

a transparent plate; and an antireflective film formed on a surface of the transparent plate.

6. The timepiece according to claim 2, wherein the first insulating layer includes:

a transparent plate; and an antireflective film formed on a surface of the transparent plate.

7. The timepiece according to claim 3, wherein the first insulating layer includes:

a transparent plate; and an antireflective film formed on a surface of the transparent plate.

8. The timepiece according to claim 4, wherein the first insulating layer includes:

a transparent plate; and an antireflective film formed on a surface of the transparent plate.

9. The timepiece according to claim 1, wherein the second insulating layer and the second transparent electrode have cutout portions, and wherein the cutout portions expose the first transparent electrode.

10. The timepiece according to claim 2, wherein the second insulating layer and the second transparent electrode have cutout portions, and wherein the cutout portions expose the first transparent electrode.

11. The timepiece according to claim 3, wherein the second insulating layer and the second transparent electrode have cutout portions, and wherein the cutout portions expose the first transparent electrode.

12. The timepiece according to claim 4, wherein the second insulating layer and the second transparent electrode have cutout portions, and wherein the cutout portions expose the first transparent electrode.

13. The timepiece according to claim 5, wherein the second insulating layer and the second transparent electrode have cutout portions, and wherein the cutout portions expose the first transparent electrode.

14. The timepiece according to claim 6, wherein the second insulating layer and the second transparent electrode have cutout portions, and wherein the cutout portions expose the first transparent electrode.

15. The timepiece according to claim 7, wherein the second insulating layer and the second transparent electrode have cutout portions, and wherein the cutout portions expose the first transparent electrode.

16. The timepiece according to claim 8, wherein the second insulating layer and the second transparent electrode have cutout portions, and wherein the cutout portions expose the first transparent electrode.

* * * * *